US006604306B1

(12) United States Patent
Burroughs et al.

(10) Patent No.: US 6,604,306 B1
(45) Date of Patent: Aug. 12, 2003

(54) STITCHERY FRAME AND METHOD

(76) Inventors: Margaret E. Burroughs, P.O. Box 2235, Helendale, CA (US) 92342-2235; William H. Burroughs, P.O. Box 2235, Helendale, CA (US) 92342-2235; Henry Evan Burroughs, 6325 Joseph St. South East, Salem, OR (US) 97302

( * ) Notice: Subject to any disclaimer, the term of this patent is extended or adjusted under 35 U.S.C. 154(b) by 0 days.

(21) Appl. No.: 10/053,998

(22) Filed: Jan. 24, 2002

(51) Int. Cl.[7] ..... D06C 3/08
(52) U.S. Cl. ..... 38/102.4
(58) Field of Search ..... 38/102.4, 102.3, 38/102.5, 102.6, 102.7; 160/371, 372, 374.1, 375, 381, 378; 101/127.1

(56) References Cited

U.S. PATENT DOCUMENTS

| | | | | | |
|---|---|---|---|---|---|
| 2,451,207 | A | * | 10/1948 | Ferguson | 28/152 |
| 3,811,209 | A | * | 5/1974 | Hanley | 38/102.6 |
| 3,949,500 | A | * | 4/1976 | Connors | 38/102.5 |
| 3,949,802 | A | * | 4/1976 | Buratovich | 160/374.1 |
| 4,301,853 | A | * | 11/1981 | Vidal | 160/374.1 |
| 4,322,901 | A | * | 4/1982 | Spitzke | 38/102.6 |
| 4,462,174 | A | * | 7/1984 | Messerschmitt | 38/102.1 |

* cited by examiner

*Primary Examiner*—Ismael Izaguirre
(74) *Attorney, Agent, or Firm*—Gene W. Arant

(57) ABSTRACT

A stitchery frame having manually operated tension devices located outside the work area for increasing spacing at both side bars and end bars in order to tighten fabric when work is in progress.

4 Claims, 2 Drawing Sheets

STITCHERY FRAME AND METHOD

FIELD OF THE INVENTION

Stitching ornamental patterns into fabrics such as congress cloth, linen, or needlepoint canvas.

PRIOR ART

Pertinent prior art includes U.S. Pat. No. 3,811,209.

SUMMARY OF THE INVENTION

According to the invention a method is provided for stitching a piece of fabric such as congress cloth, linen, or needlepoint canvas that is supported within a rectangular frame, in which the existing fabric within the frame is kept taut at all times, with convenient manual adjustments of an adjustment mechanism. After some stitching has been done, the fabric can then be restretched in two mutually perpendicular directions from each of its four corners and directly within the plane of the fabric to cause it to assume a more tightly stretched condition. Then more stitches are added into the fabric, and the process is repeated.

According to the invention a stitchery frame is provided with a tensioning device on each of the four outside corners of its perimeter, thus making it possible to apply pressure to a cross member and push it away from its parallel partner. This arrangement is preferably duplicated for both end bars and side bars of the stitchery frame.

DRAWING SUMMARY

DESCRIPTION OF PREFERRED EMBODIMENT

Figure 8:
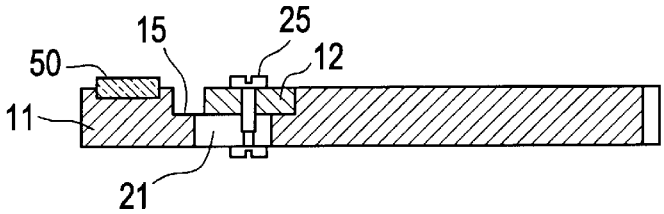
FIG. 8 is a cross-sectional elevation view taken on line 8—8 of FIG. 7.

A stitchery frame F is generally rectangular in shape (although as a special case, it may be exactly square), with end bars 11 and side bars 12. Each end bar 11 has a recess 15 near each of its ends, and each side bar 12 has a recess 17 near each of its ends. The combined depth of one end bar recess and one side bar recess is substantially equal to the thickness of each of the end and side bars, so that one end bar and one side bar may be arranged perpendicular to each other with their recesses at one of their ends interengaged to form a corner of the frame F. When the bars are thus interengaged, both the side bar and the end bar occupy a common plane. See FIG. 8.

It will be noted that each of the end bar recesses 15 is longer than the width of side bars 12, so that a side bar placed within recess 15 can still move longitudinally of the associated end bar. See FIG. 8. In similar fashion, each side bar recess 17 is longer than the width of end bars 11, so that an end bar engaging that recess can still move longitudinally of the side bar. Arrows 20, vertically opposed to each other, indicate that movement of this type is available at each corner of the frame F. This kind of adjustability permits the space between end bars 11 to be slightly increased, and also permits the space between side bars 12 to be slightly increased.

To hold the positions of the corners of the frame F, a lost motion connector is provided at each corner. Thus, end bars 11 have elongated slots 21 in their recesses 15, while side bars 12 have elongated slots 22 in their recesses 17. The structure of each lost motion connector is completed by a bolt 25 which passes through slots 21 and 22 but is loosely captured by its associated nut, so that sliding movement of the bars is not inhibited by that mechanism.

Associated with each lost motion connector is a manual adjustment screw 30 which, very importantly is located outside the frame F. The screw is supported by an L-shaped bracket 32, one of whose sides 33 is secured to an end or side bar, while its other side is threaded to threadedly receive the adjustment screw 30. The outer end of adjustment screw 30 has a finger tab 35, while its inner end engages and is pressed upon the side or end bar. There are eight adjustment screws 30, and each screw mounted upon a side bar may be operated for increasing the spacing of the end bars, while each screw mounted upon an end bar may be operated for increasing the spacing of the side bars.

Figure 1:
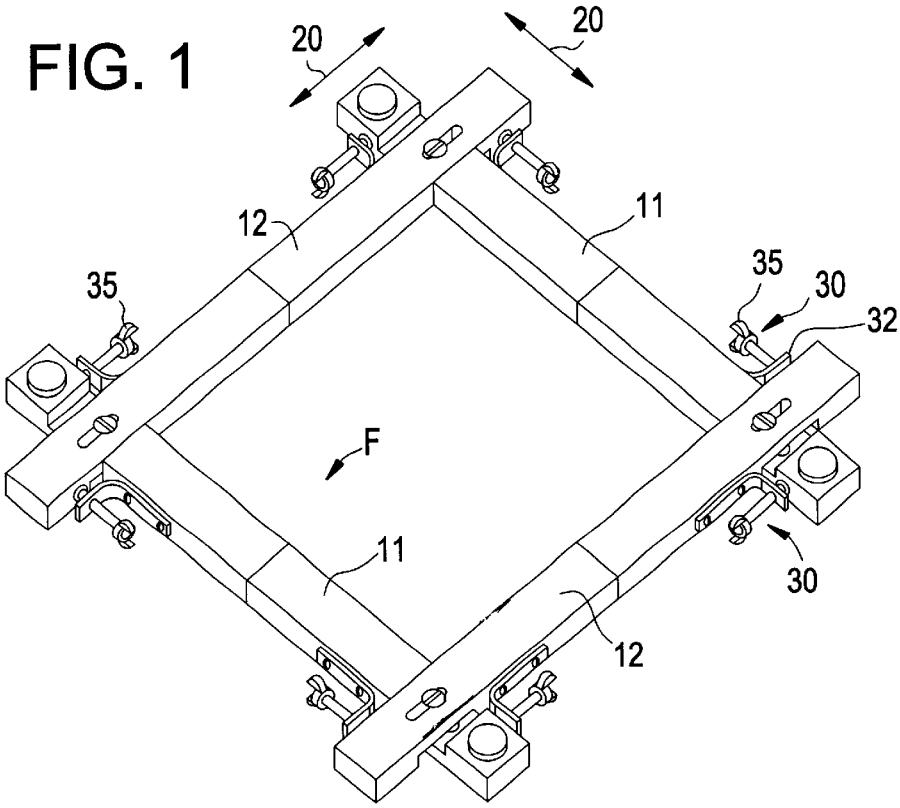
FIG. 1 is a perspective view of our new stitchery frame.
Figure 2:
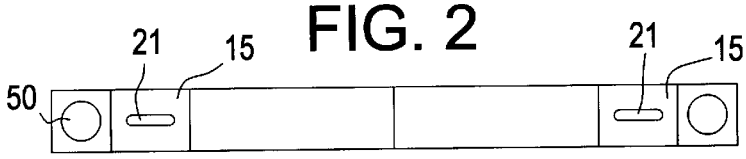
FIG. 2 is a top plan view of an end bar of the frame.
Figure 3:
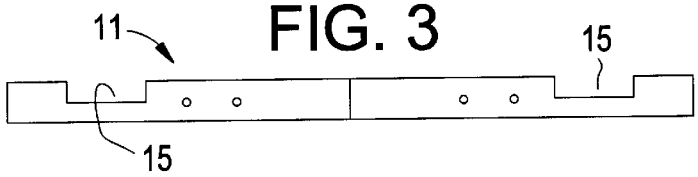
FIG. 3 is a side elevation view of the end bar of FIG. 2.
Figure 4:
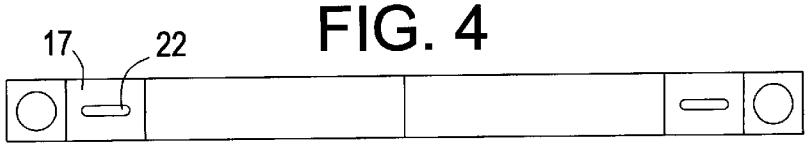
FIG. 4 is a bottom plan view of a side bar of the frame.
Figure 5:
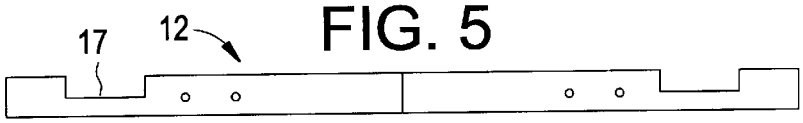
FIG. 5 is a side elevation view of the side bar of FIG. 4, when it is turned upside down.
Figure 6:
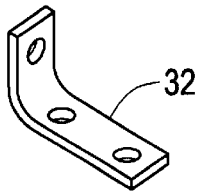
FIG. 6 is a perspective view of an L-shaped metal bracket.
Figure 7:
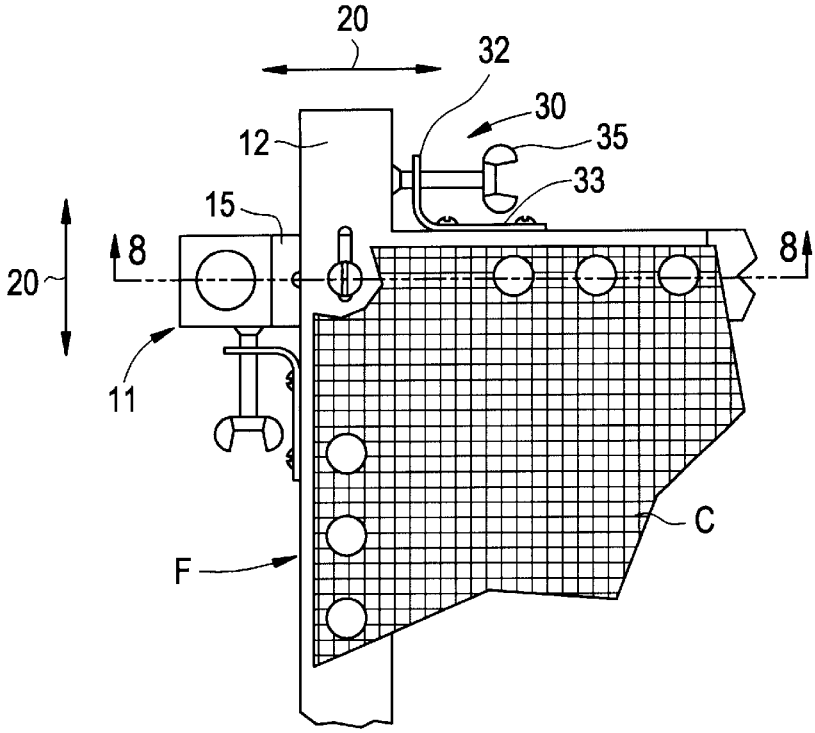
FIG. 7 is a fragmentary view of the stitchery frame when holding a fabric in operative position.

As shown in the drawings, the fabric C is preferably attached along its end and side edges throughout most of the length of the associated side and end bars, but as shown in FIG. 7 is not securely attached in the corner regions. The reason for that is to allow adjustment of the tension of the fabric without destroying its configuration.

In operation, when a certain amount of stitching has been done and it is desired to tighten the fabric, all of the eight adjustment screws are used for that purpose. A single adjustment screw for moving a side bar, for example, would likely move it out away from a precisely parallel alignment with the opposite side bar, but when both adjustment screws at one end of the frame F are tightened at the same time, it is conveniently possible to maintain precisely correct alignment of the frame members. Thus, a major problem of the prior art is solved by placing the tensioning mechanisms outside the work area, and using tensioning devices that are hand operated, easy to grasp, and do not require a special tool of any kind.

Since the adjustment screws and their supporting brackets are located entirely outside the boundaries of frame F, their adjustment only affects the spacings between side bar pairs and end bar pairs, which in turn controls tautness of the fabric. It is important that the stretching movement applied to the fabric is applied exactly within the plane of the fabric itself, rather than in some other or different plane. Stretching is done as needed to correct for the looseness that is caused by the fabric being stretched when stitches are added to it.

Magnets 50 held in additional recesses at the ends of the end and side bars are provided as a convenient accessory to hold needles and the like, during the stitching operation.

What we claim is:

1. The method of stitching a piece of fabric such as congress cloth, linen, or needlepoint canvas that is supported within a rectangular frame, comprising the steps of:

adding stitches into the existing fabric within the frame;

then stretching the fabric in two mutually perpendicular directions from each of the four corners of the frame and directly within the plane of the fabric to cause it to assume a more tightly stretched condition;

then adding more stitches into the fabric; and thereafter repeating both the stretching and the stitching.

2. The method of stitching a piece of fabric such as congress cloth, linen, or needlepoint canvas that is supported within a rectangular frame having side and end pieces, comprising the steps of:

placing the fabric within the frame;

attaching corresponding edges of the fabric along the side and end pieces of the frame;

applying tension from the frame to the fabric directly in the plane of the fabric by expanding the spacing between the side pieces and concurrently expanding the spacing between the end pieces;

adding stitches into the fabric while maintaining the tension thus applied to the fabric; and then again expanding the spaces between both end pieces and side pieces of the frame.

3. A stitchery apparatus comprising:

a rectangular frame including a pair of side bars and a pair of end bars, each side bar having a recess near each of its ends, and each end bar also having a recess near each of its ends, the combined depths of side bar recesses and end bar recesses being such that a side bar and an end bar may be placed at a right angle to each other with recesses at one end of each being interengaged to form a corner of the frame while at the same time the bars occupy a common plane;

the length of the recesses in the end bars being greater than the width of the side bars, and the length of the recesses in the side bars being greater than the width of the end bars, the four bars thus forming an expandable frame in which the space between side bars may be expanded and the space between end bars may also be expanded;

four lost motion connectors at the four corresponding corners of the frame securing the respectively interengaged recessed portions of a side bar and an end bar such that there may be relative movement of the bars in two mutually perpendicular directions, each of the lost motion connectors being formed by longitudinal slots in each of the bars, and a bolt occupying both slots; and manual adjustment means associated with each corner of the frame but physically located outside the frame so that both the width and length of the frame may be manually adjusted without directly entering the space inside the frame that is intended to be occupied by the fabric.

4. A stitchery apparatus comprising:

a rectangular frame including a pair of side bars and a pair of end bars, each side bar having a recess near each of its ends, and each end bar also having a recess near each of its ends, the combined depths of side bar recesses and end bar recesses being such that a side bar and an end bar may be placed at a right angle to each other with recesses at one end of each being interengaged to form a corner of the frame while at the same time the bars occupy a common plane;

the length of the recesses in the end bars being greater than the width of the side bars, and the length of the recesses in the side bars being greater than the width of the end bars, and the four bars thus forming an expandable frame in which the space between side bars may be expanded and the space between end bars may also be expanded;

four lost motion connectors at the four corresponding corners of the frame securing the respectively interengaged recessed portions of a side bar and an end bar such that there may be relative movement of the bars in two mutually perpendicular directions; and manual adjustment means including a screw associated with each corner of the frame but physically located outside the frame so that both the width and length of the frame may be manually adjusted without directly entering the space inside the frame that is intended to be occupied by the fabric.

* * * * *